US005844456A

United States Patent [19]

Mader

[11] Patent Number: 5,844,456

[45] Date of Patent: Dec. 1, 1998

[54] ELECTROMAGNETIC RELAY

[75] Inventor: Leopold Mader, Moedling, Austria

[73] Assignee: EH-Schrack Components-AG, Vienna, Austria

[21] Appl. No.: 805,251

[22] Filed: Feb. 24, 1997

[30] Foreign Application Priority Data

Feb. 23, 1996 [DE] Germany ..... 196 06 884.3

[51] Int. Cl.[6] ..... H01H 51/22

[52] U.S. Cl. ..... 335/78; 335/128; 335/86; 335/61

[58] Field of Search ..... 335/78–86, 61, 335/128

[56] References Cited

U.S. PATENT DOCUMENTS

| | | | |
|---|---|---|---|
| 4,720,694 | 1/1988 | Schroeder | 335/128 |
| 4,743,877 | 5/1988 | Oberndorfer et al. | 335/128 |
| 4,910,484 | 3/1990 | Shikano et al. | 335/61 |
| 5,515,019 | 5/1996 | Schedele | 335/78 |
| 5,673,012 | 9/1997 | Stadler et al. | 335/78 |
| 5,734,308 | 3/1998 | Dittmann et al. | 335/78 |

FOREIGN PATENT DOCUMENTS

| | | |
|---|---|---|
| 0 186 160 | 7/1986 | European Pat. Off. . |
| 0 375 398 A2 | 12/1989 | European Pat. Off. . |
| 36 44 172 C2 | 12/1986 | Germany . |
| 39 08 442 C2 | 3/1989 | Germany . |

*Primary Examiner*—Michael L. Gellner
*Assistant Examiner*—Tuyen T. Nguyen
*Attorney, Agent, or Firm*—Hill & Simpson

[57] ABSTRACT

An electromagnetic relay is provided with an electromagnet system with a U-shaped core yoke and an essentially flat armature, which form a working air gap on a longitudinal side underneath the coil winding. One yoke limb lies immediately on the coil winding, so that the make motion of the armature is towards the coil. In this way, a relatively large contact room is formed underneath the yoke limb and a movable contact spring extends approximately parallel under the armature. The contact spring is actuated by the armature which draws an actuating element. The relay enables a relay for high switching capacity with a changeover contact and with large insulating distances between the magnet system and the contact arrangement.

30 Claims, 5 Drawing Sheets

ELECTROMAGNETIC RELAY

BACKGROUND OF THE INVENTION

1. Field of the Invention

The invention relates electromagnetic relays. More specifically, the invention relates to electromagnetic relays with electromagnet systems.

An unpoled relay with the construction named above is known for example from EP 0 375 398 A2. There as well, the magnet systems which contain a U-shaped core yoke, whereby an armature is mounted at one core end, and with one yoke limb forming the working air gap underneath the coil. However, in these examples, the armature is arranged in the overlap region between the yoke limb and the coil, so that the switching movement of the armature is directed outward from the coil. The contacts are located underneath the moving armature, whereby no optimal use of space results. Correspondingly, the relay has to make only contact, while a changeover contact requires additional construction height. Since it is also the case there that no large insulating clearances are possible between the magnet system and the contact arrangement, the switching capacity is limited.

SUMMARY OF THE INVENTION

The aim of the present invention is to create a relay of the type named above with a flat construction and as small a volume as possible, in which a good use of space is achieved with few parts. The relay should be able to handle high switching capacity with low excitation power. In addition, the construction should also enable a good insulation between the magnet system and the contact arrangement. The contact arrangement should enable both a make or, respectively, break contact and a changeover contact within the mentioned low construction.

According to the invention, this aim is achieved with a relay of the type named above in that the pole segment of the yoke limb lies between the armature and the coil, and in that the switching spring extends essentially underneath the armature, and in that the contacts are arranged in a contact space formed underneath the yoke limb in the region in front of the movable armature end.

The electromagnetic relay of the present invention consists of an elongated coil with an axis oriented parallel to a base plane, a U-shaped core yoke, of which a core limb passes axially through the coil and, parallel thereto, a yoke limb extends underneath the coil over a part of the coil length and forms a pole segment, and an essentially flat armature, which extends underneath the coil approximately in prolongation of the yoke limb, is mounted with a bearer end segment at the free end of the core, and, with an opposed pole end segment, overlaps the pole segment of the yoke limb so as to form a working air gap. In addition having a contact arrangement with at least one fixed contact fastened on a bearer and having a movable contact supported by a switching spring, and having an actuating element for the transmission of the armature motion to the switching spring.

By means of the inventive construction of the magnet system, upon excitation, the armature and the switching spring are drawn to the coil. In this construction, the yoke limb lies as close as possible to the coil, so that the contact space located underneath the yoke limb has more height available than the region located underneath the movable armature. In this way, it is unproblematically possible, with an otherwise small construction size, to house a changeover contact, while the switching spring can essentially extend underneath the movable armature, approximately parallel to it, approximately over the entire length of the relay. The actuating element thereby engages with the switching spring in the region between the clamping and the contact end of the switching spring.

In a particularly useful construction, a base element made of insulating material is arranged underneath the magnet system. The base element supports the switching spring and the bearers for the fixed contacts. The base element also forms a partition between the magnet system and the contact arrangement. The base element further comprises only one opening for the actuating element. Given a corresponding construction of the actuating element, two openings can of course also be provided. The partition of the base element is constructed in stepped form, in order on the one hand to form the higher contact space underneath the yoke limb and on the other hand to provide sufficient space underneath the armature for the switching motion thereof. In a useful embodiment, the base element furthermore has side walls integrally formed downward, which surround the switch room at least partially, in which the spring bearers that support the switching springs, as well as a make contact bearer and/or a break contact bearer, are anchored by means of plug fastening into plug wells.

To improve insulation in the region of the opening, at the edge thereof the partition can form an insulating collar that projects to the underside. In an advantageous construction, the actuating element itself has a hook part hung on the armature and a foot portion that engages with the switching spring. The foot portion can interlock with the insulating collar in labyrinth fashion. In this way, particularly long creepage distances are created between the armature or, respectively, the magnet system on the one hand and the switching spring on the other hand, whereby the relay is suited for high switching capacity despite low construction height.

In a useful construction, the essentially elongated armature has a short bearing end segment angled off towards the core, mounted in a recess of a coil body flange surrounding the core end on three sides. When the magnet system is not excited, the armature is preferably pre-stressed with its movable end away from the yoke limb by means of a reset spring, whereby it lies pivotably with a middle section on a lever line of the base element parallel to the bearing axis, so that on the basis of the lever effect its bearing segment is pressed into the bearing. This lever or fulcrum line is usefully formed by a roll-off edge of the base element. However, it would also be possible to provide an edge or laterally extending ledge in the middle area of the armature itself, with which it could also roll off from a flat surface of the base element. The reset spring is usefully fashioned by means of at least one reset limb that is connected with the switching spring in one piece, but is separated in terms of effect from a contact spring supporting the movable contact.

BRIEF DESCRIPTION OF THE DRAWINGS

In the following, the invention is explained in more detail on the basis of exemplary embodiments, based on the following drawings wherein.

It should be understood that the drawings are not necessarily to scale and that the embodiments sometimes are illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
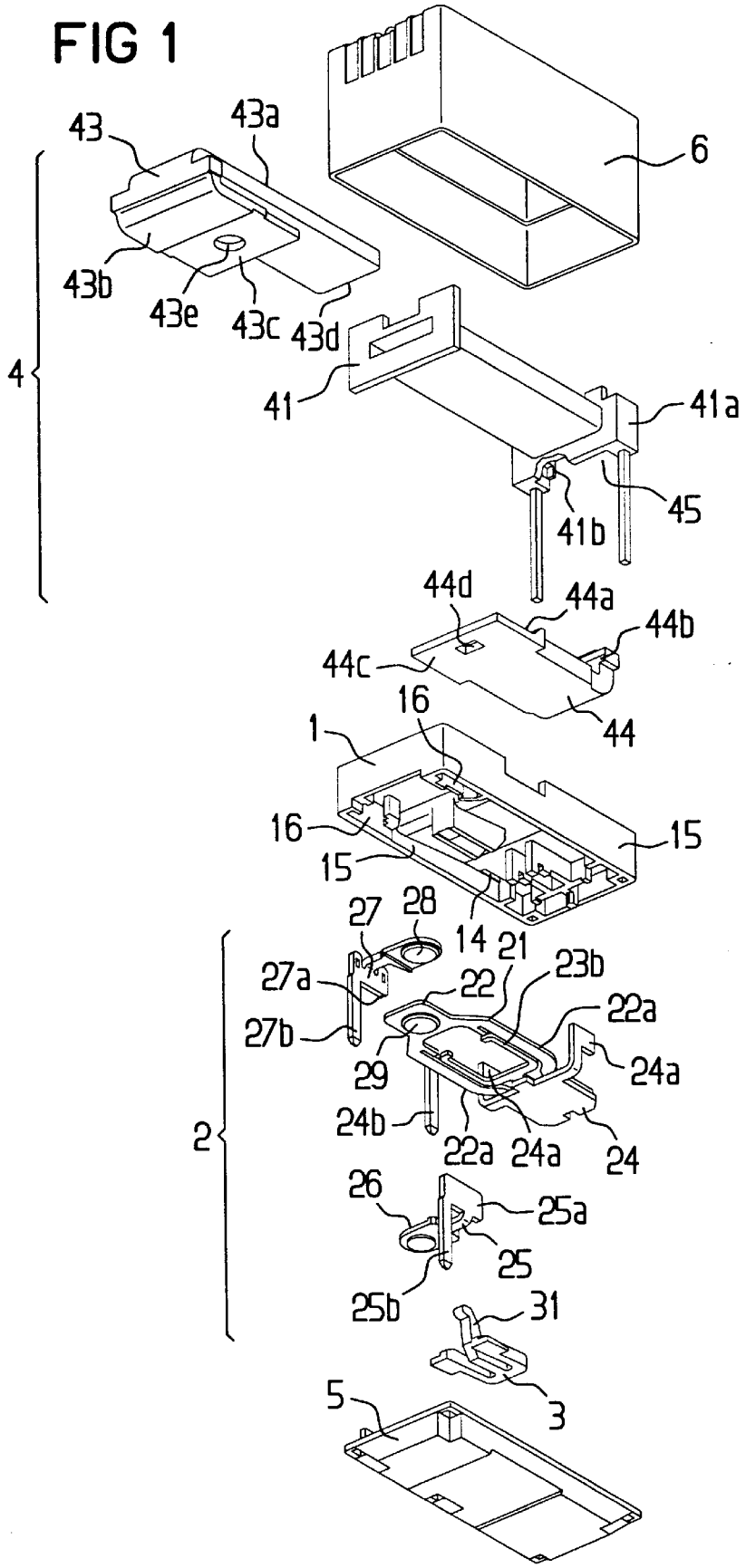
FIG. 1 is an exploded view of a relay made in accordance with the present invention.

As illustrated in FIG. 1, the relay shown in FIGS. 1 to 7 consists of a base element 1 that bears on its underside a contact arrangement 2 with an actuating element 3, as well as a magnet system 4 arranged above the base element. The relay system is arranged in a housing formed by a base plate 5 and a cap 6.

Still referring primarily to FIG. 1 (unless otherwise noted), the base element 1 is fashioned in the form of a box from insulating material, and forms a partition 11 (see FIG. 5) between the magnet system 4 and the contact arrangement 2. The contact arrangement 2 comprises only one opening 12 for the actuating element or actuator 3. A switch room 13 (see FIG. 2) is fashioned underneath the partition 11. The switch room 13 is surrounded by side walls 14 (see FIG. 1) of the base element 1 and which goes over on one side, by means of a stepped construction of the partition 11 (see FIG. 5), into a contact room 13*a* (see FIG. 2) with a larger height. In the switch room, there extends over the larger part of the length of this room a switching spring 21, approximately parallel to the base side of the relay, which side is determined by the base plate 5. The switching spring 21 is a flat plate spring, and forms a frame-shaped contact spring 22 with current-conducting side limbs 22*a*, which unite towards the free end to form a contact segment 22*b* (see FIG. 3). A movable contact 29 is fastened on this segment. In addition as shown in FIG. 3, on the contact segment 22*b*, two actuating tabs 22*c* are cut free on both sides within the frame shape, in such a way that they point in the direction of the clamping point.

Figure 3:
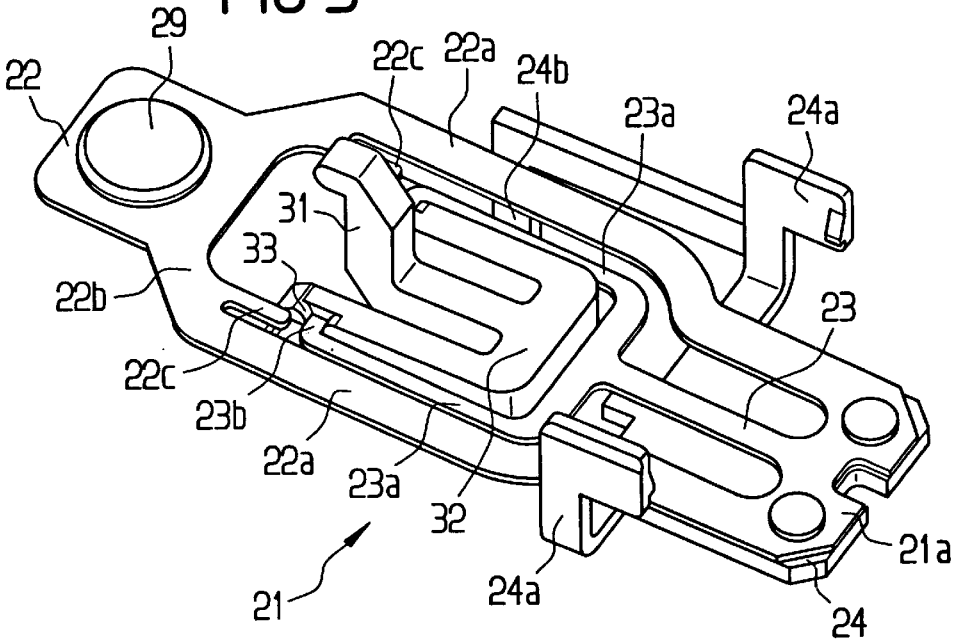
FIG. 3 is a top perspective view of a switching spring with spring bearer and actuating element first shown in FIG. 1.

As best illustrated in FIG. 3, the switching spring 21 forms, in one piece with the contact spring 22, a fork-shaped reset spring 23, which is essentially separated from the fastening end 21 a of the switching spring, going out from the contact spring 22, and runs with two reset limbs 23*a* essentially parallel within the frame shape of the contact spring 22, in parallel next to the side limbs 22*a* thereof. The reset spring 23 forms, with its reset limbs 23*a*, a U-shape that is adapted to the outer contour of the actuating element 3, which is still to be specified.

The switching spring 21 is fastened at its fastening end 21 a to a spring bearer 24, which for its part is anchored to side walls 15, lying opposite one another, of the base element 1, via fastening tabs or elements 24*a* in plug wells or slots 14 (see also FIG. 1). The fastening tabs 24*a* have hook-shaped contours for better anchoring. Moreover, a terminal lug 24*b* is integrally formed onto the spring bearer 24, which lug is led outward through a corresponding opening of the base plate 5.

Figure 2:
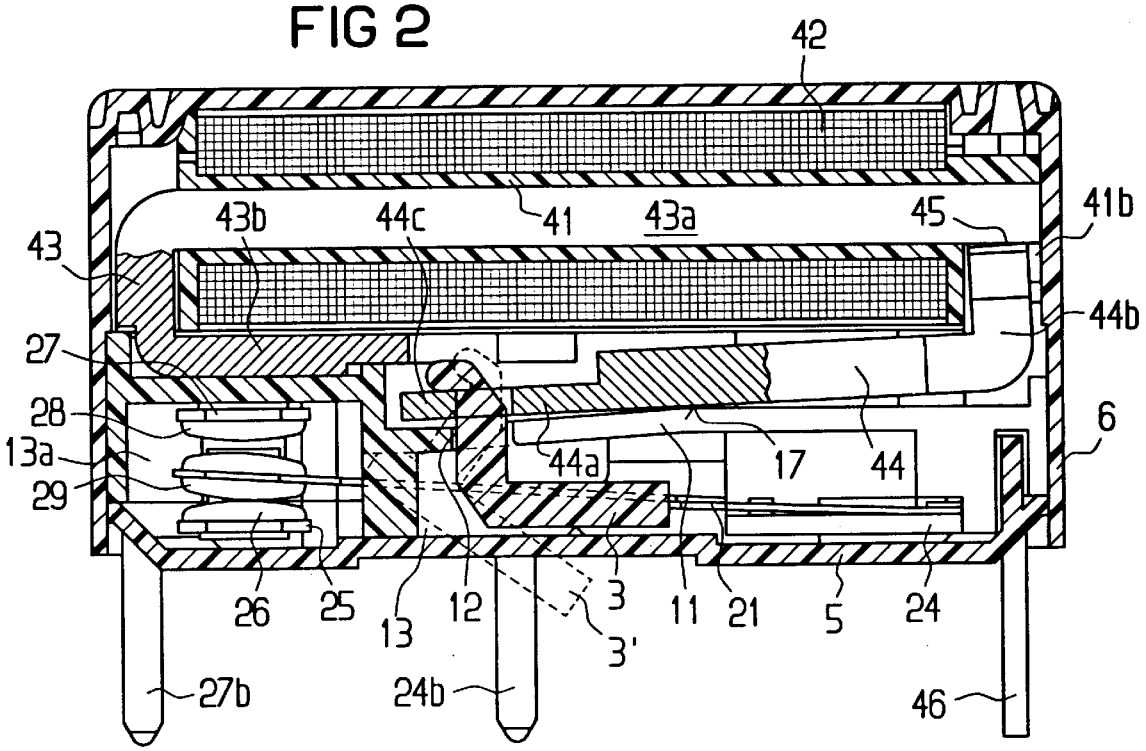
FIG. 2 is a longitudinal sectional view of the assembled relay of FIG. 1.

As illustrated in FIGS. 1 and 2, the contact arrangement further comprises a break contact bearer 25 with a break contact 26, as well as a make contact bearer 27 with a make contact 28. Both contact bearers are anchored in corresponding plug wells 16 of the base element 1 via fastening segments 25*a* or, respectively, 27*a*. Moreover, the break contact bearer 25 and make contact bearer 27 respectively possess terminal lugs 25*b* or, respectively, 27*b*, which are led outward through the base plate 5. The contact bearers 25 and 27 are so constructed and are so arranged in the contact room 13*a* that the movable contact 29 alternatively works together with the break contact 26 and the make contact 28.

The magnet system 4, arranged above the base element 1, has a coil body 41 with a winding 42 whose axis lies parallel to the base side of the relay. A core yoke 43 forms, in one piece, a core limb 43*a*, which extends axially through the entire coil, and a yoke limb 43*b*, which extends parallel to the core limb underneath the coil, close to the winding, up to about half the coil length.

An armature 44 extends with its main part flat in prolongation of the yoke limb 43*b*, whereby a pole end segment 44*a*, set back in cross-section, overlaps a pole segment 43*c*, likewise reduced in cross-section, of the yoke limb. A bearing end segment 44*b* of the armature is angled toward the free core end 43*d*, and is so mounted in a pocket 45 of a coil body flange 41*a* that it rolls off to the free core end 43*d*. The coil body flange 41*a* surrounds this free core end 43*d* on three sides, and also secures the bearing end segment 44*b* of the armature against drifting in the axial direction of the coil with holding ribs 41*b*.

In addition, this bearing end segment 44*b* of the armature is pressed into the bearing on the core end 43*d* by the resetting force of the reset spring 23. This resetting force works on the movable armature end 44*c*, and draws it away from the coil in the downward direction. By this means, when the magnet system 4 is not excited, the armature 44, as a lever, is pivoted about a roll-off edge 17 on the upper side of the partition 11 (counterclockwise in the representation of FIG. 2) in such a way that the bearing end segment 44*b* of the armature is pre-stressed into the bearing. In other words, the edge 17 serves as a fulcrum point for the armature 44. In this way, a separate bearing spring can be dispensed with.

By means of the arrangement of the yoke limb 43*b* immediately on the winding 42 (with an insulating layer in between, if necessary), upon excitation of the magnet system, the armature 44 is drawn in the direction towards the coil, so that the switching spring 21 is also drawn in this direction via the actuating element 3. In this way, there results the already-mentioned large contact room 13*a* underneath the yoke limb 43*b*, while for the switching spring 21 the lower switch room 13 underneath the movable armature is sufficient. The actuating element 3, which transmits the switching motion of the armature 44, has a hook part 31, which passes, essentially perpendicular to the base element 1, through the opening 12 of the partition 11, and is hung with its hook-shaped end 31 on an opening 44*d* of the armature 44. A recess 43*e* is also provided in the pole segment 43*c* of the pole limb 43*b* over the free end of this hook part 31, which recess enables the armature to lie completely on the yoke limb in this region.

Figure 6:
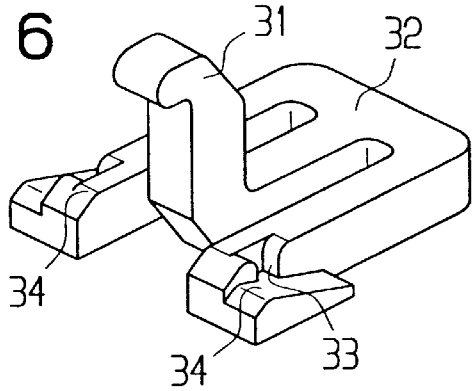
FIG. 6 is a perspective view of the actuating element first shown in FIG. 1.
Figure 7:
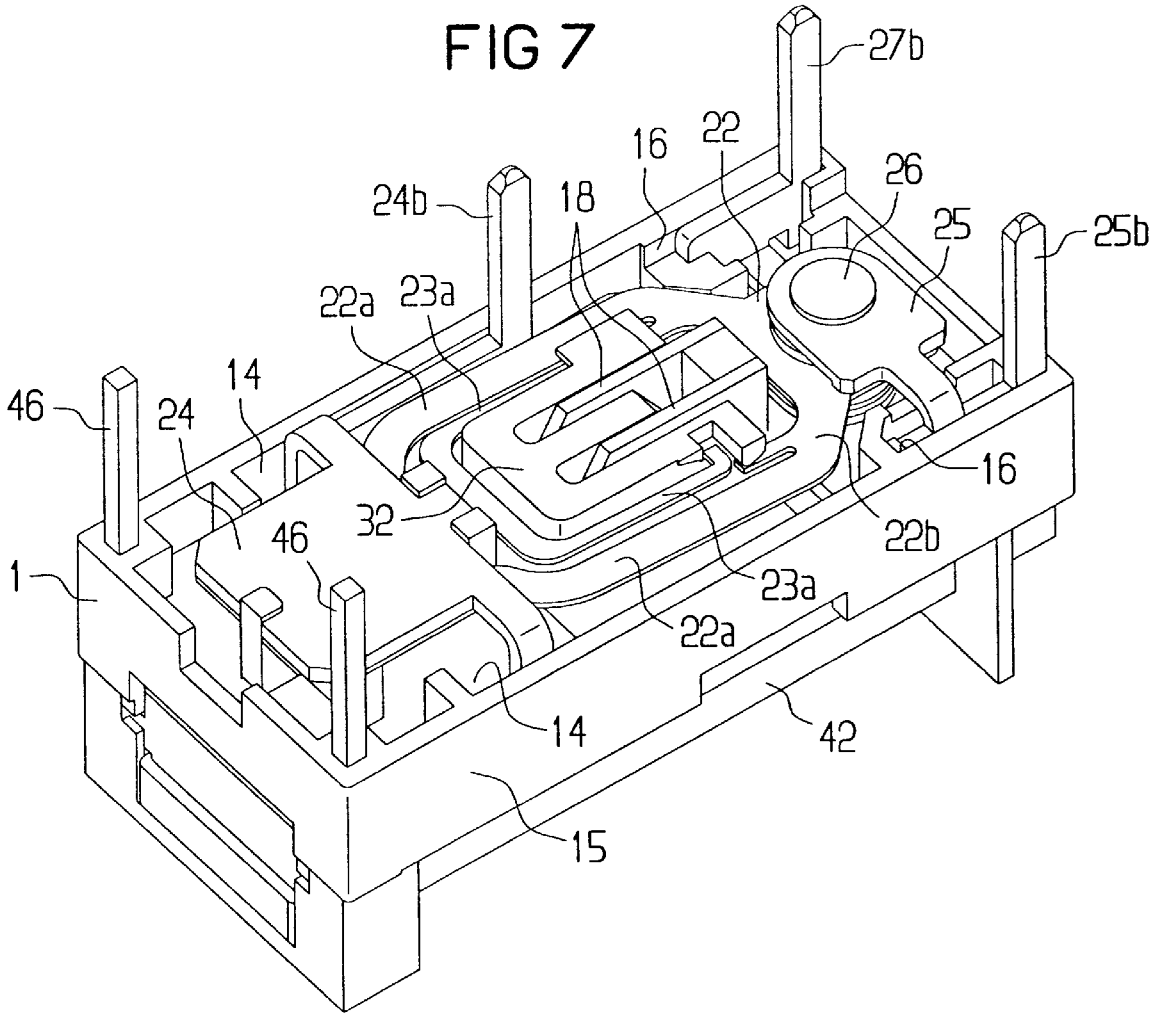
FIG. 7 is a bottom perspective view of the base element, with assembled contact arrangement.

As shown in FIG. 6, the actuating element 3 has a flat foot part 32 that lies essentially in the plane of the switching spring 21, and, in this example, has an M-shaped construction. The middle limb of the M is thereby connected with the hook part 31. A guide groove 33 is respectively formed in both outer limbs of the foot part 32, in which a guide nose 23*b* of the adjacent reset limb 23*a* respectively engages. On the free ends of this outer limb, an actuating cam 34 is respectively laterally integrally formed, which cam lies underneath the adjacent actuating tab 22*d* of the contact spring, and brings the contact spring into the make or closed position upon an upward-directed motion of the actuating element 3. By matching the heights of the upright point on the actuating cam 34 on the one hand and of the guide grooves 33 on the other hand, the reset position of the armature can be set in relation to the make position of the break contact, even if the reset spring and the contact spring are originally located in one plane. Otherwise, a corresponding position can however also be set through a slight bending of the reset limb 23*a* on the one hand or, respectively, of the actuating tabs 22*c* on the other hand.

In order to increase the insulation between the magnet system 4 and the contact arrangement 2, an insulating collar 18 is integrally formed on the partition 11 toward the underside, which engages in labyrinth fashion between the limbs of the M-shaped foot part 32 of the actuating element 3, and in this way creates long creep paths.

Figure 4:
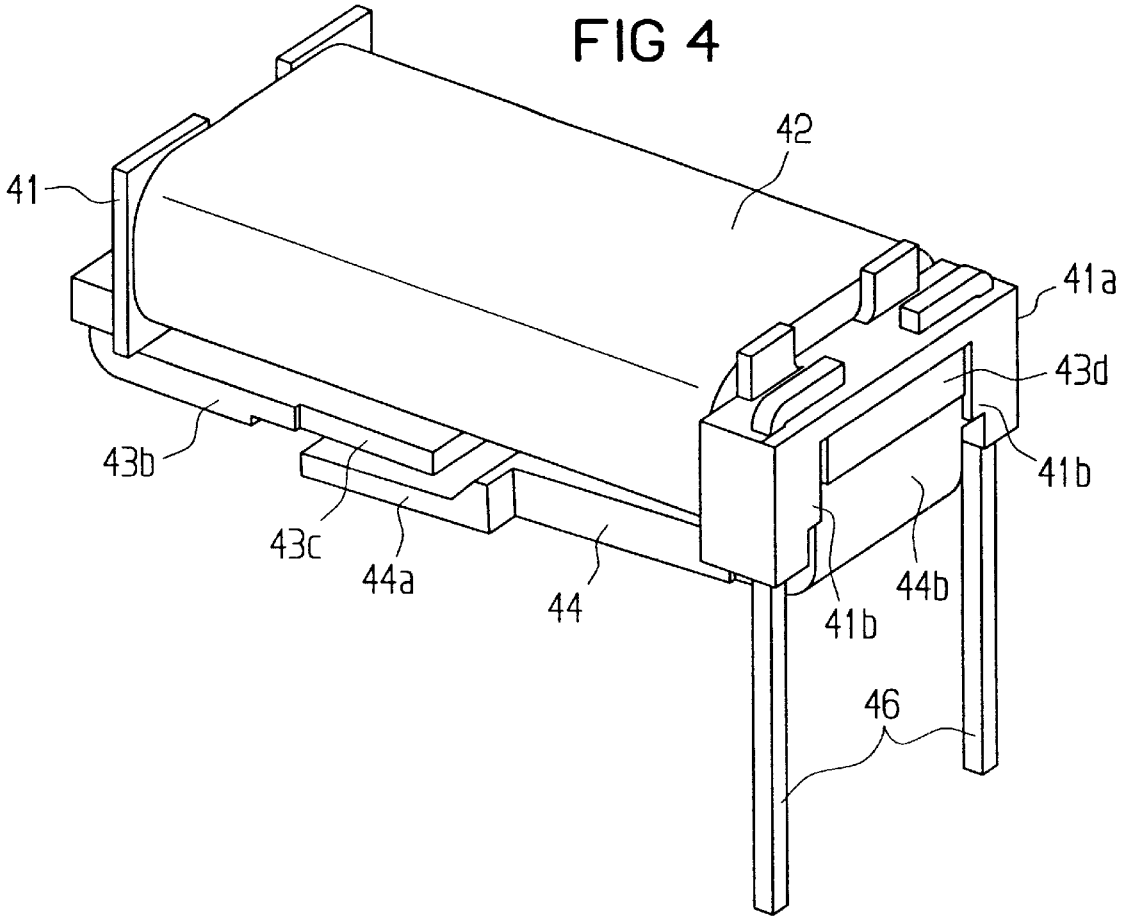
FIG. 4 is a perspective view of the magnet system first shown in FIG. 1.
Figure 5:
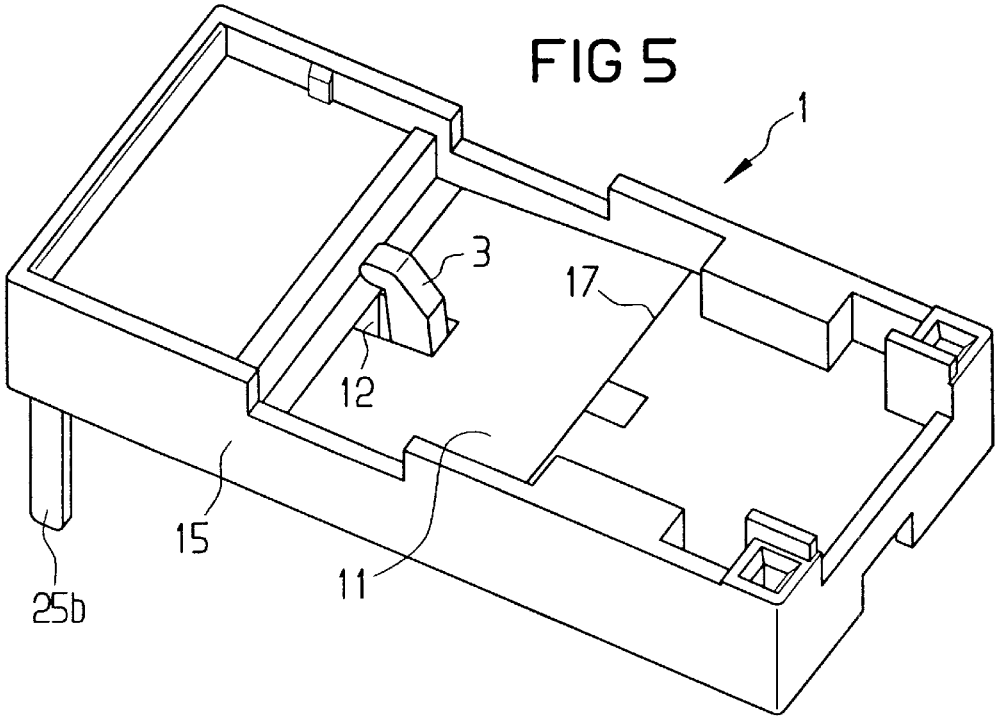
FIG. 5 is a top perspective view of the base element first shown in FIG. 1.

The assembly of the relay is designed in a way such that the magnet system according to FIG. 4 is pre-assembled and the contact arrangement 3 is anchored in the base element from the underside. The magnet system according to FIG. 4 is assembled with the base element according to FIG. 5, whereby coil terminal pins 46 are plugged into corresponding openings of the base element. The actuating element 3 is then plugged through the frame-shaped switching spring from the underside in, and is hooked into the armature 44. For this purpose, the actuating element 3 is first led upward in an angled position, as shown in broken lines in FIG. 2 with the reference character 3', is plugged into the opening 12 with the hook part 31 and is then pivoted into the final position. By means of this type of assembly of the actuating element without snap connections, all plastic wear, which could endanger the contacts, is also avoided. By setting on the base plate 5 and the cap 6, the housing is then formed, which can also be sealed in a known fashion.

The function of the relay results already from the specified allocation of the parts. Given an excitation of the magnet system, the armature 44 is drawn with its pole end segment 44*a* to the pole segment 43*c* of the yoke limb 43*b*, whereby the contact spring 22 is drawn upwards via the actuating element 3 and the movable contact 29 is brought into contact with the make contact 28. When the excitation is switched off, the reset spring 23, with its reset limbs 23*a*, draws the actuating element 3 and the end 44*c* of the armature downward, whereby the armature tips in the manner of a lever on the roll-off edge 17, and its bearing end segment 44*b* is pre-stressed to the yoke end 43*d*, even without excitation of the coil.

Figure 8:
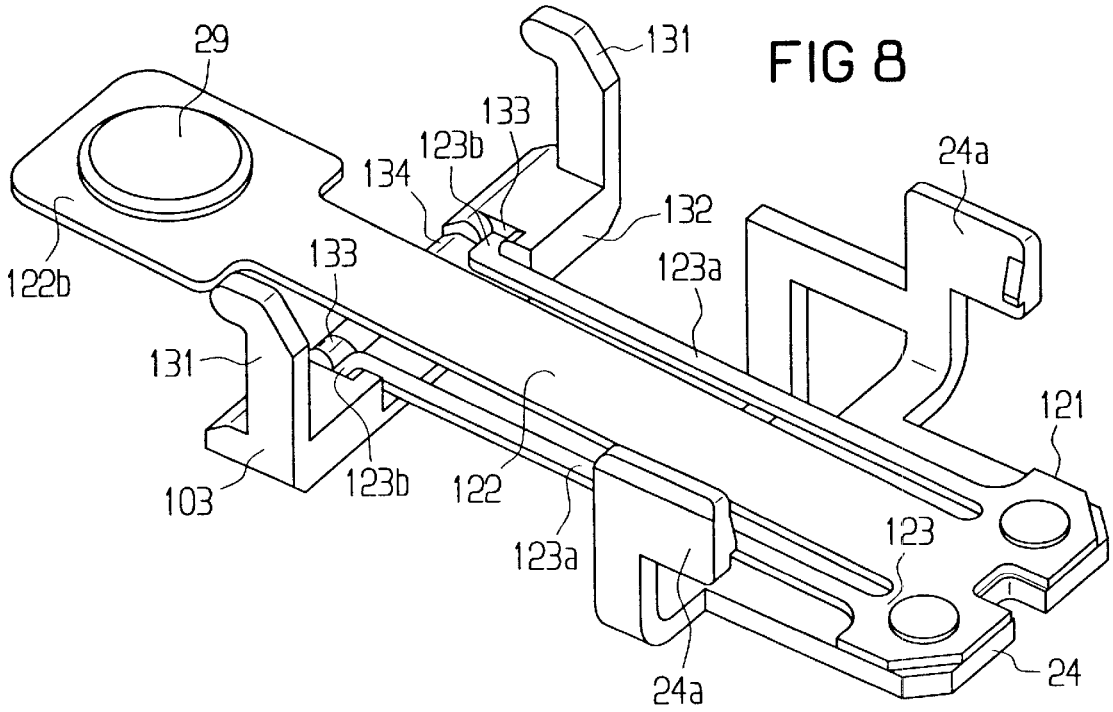
FIG. 8 is a perspective view of an alternative embodiment of the switching spring illustrated in FIG. 3.
Figure 9:
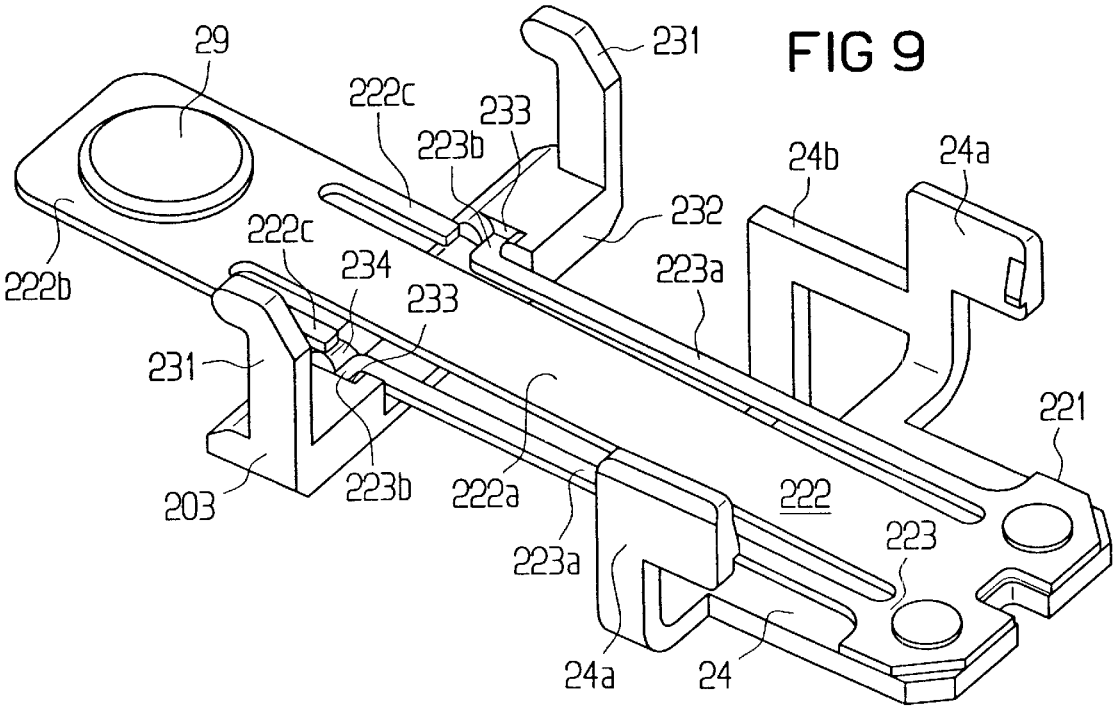
FIG. 9 is a perspective view of an alternative embodiment of the switching spring illustrated in FIG. 3.

FIGS. 8 and 9 show two further possible embodiments of the switching spring, and correspondingly of the actuating element. The switching spring according to FIG. 8 accordingly possesses a contact spring 122, which, in a modification relative to the contact spring 22 of FIG. 3, now has only a single limb arranged in the center, at whose end a contact segment 122*b* bears the movable contact 29. In this case, the reset spring 123 is formed by two reset limbs 123*a*, which run next to the outer sides of the contact spring on both sides, and which respectively comprise actuating noses 123*b*, angled off outwardly, at their free ends. Corresponding to the modified shape of the switching spring 123, a modified actuating element 103 is also provided. This has a U-shaped construction, with two hook parts 131 as outer limbs, and a foot part 132 that connects the two hook parts, which foot part extends underneath the switching spring, transverse to it, and comprises both a centric cam segment 134 for the actuation of the contact spring 122 and two laterally arranged guide grooves 133 for the accepting of the mentioned guide noses 123*b*. The two hook parts 131 extend upward up to the armature, whereby the armature is of course correspondingly constructed on both sides in order to permit a hanging of the hook parts 131, and whereby also the base element must now comprise two externally situated openings in its partition, in place of the previously specified centric opening 12. The spring bearer 24 is constructed as in the previous exemplary embodiment.

FIG. 9 shows a further modification in relation to FIG. 8. Like the switching spring 121, the switching spring 221 has a central contact spring 222 with a contact segment 222*b*, as well as a reset spring 223 formed by externally situated reset limbs 223*a*, whereby the reset limbs respectively comprise a guide nose 223*b* at their end. The actuating element 203 is constructed in a U-shape, similar to the actuating element 103. It has two hook parts 231, as well as a foot part 232 that runs transversely, in which guide grooves 233 for the reception of the guide noses 223*b* are integrally formed, However, the actuation of the contact spring 222 now does not ensue immediately at the center limb 222*a*, but rather via laterally integrally formed actuating tabs 222*c*, which are approximately aligned with the reset limbs 223*a*, and respectively lie on an actuating cam 234 of the actuating element 203. For the adaptation of the armature and of the base element to the altered actuating element, the same holds as for FIG. 8. In other respects, the function results from the specification of the first exemplary embodiment.

From the above description, it is apparent that the objects of the present invention have been achieved. While only certain embodiments have been set forth, alternative embodiments and various modifications will be apparent from the above description to those skilled in the art. These and other embodiments are considered equivalents and within the spirit and scope of the present invention.

What is claimed is:

1. An electromagnetic relay comprising:

a U-shaped core yoke having a core limb and a yoke limb, the core limb extending through an elongated coil with a free end of the core limb being disposed outside of the coil, the yoke limb being disposed below the coil and extending along a portion of the coil, the yoke limb having an end portion forming a pole segment, the relay further comprising an armature, the armature comprising a bearer end disposed adjacent to the free end of the core limb, the armature further comprising an opposing pole end, the pole end of the armature being disposed underneath the pole segment of the core limb with a working air gap disposed therebetween, the pole end of the armature being coupled to an actuator, the actuator comprising a hook element, the armature being coupled to a switching spring and linking the pole end of armature to the switching spring, the switching spring supporting a movable contact, the movable contact being disposed between two fixed contacts, the relay further comprising a base element disposed below the yoke limb and armature and above the contacts and switching spring, the base element being fabricated from an insulating material, the base element further comprising a hole through which the hook element of the actuator passes.

2. The relay of claim 1 wherein the base element further comprises an underside for accommodating the switching spring.

3. The relay of claim 1 wherein the base element further comprises side walls which surround the contacts and form a contact room.

4. The relay of claim 1 wherein the switching spring further comprises a fastening element, the base element further comprises at least one slot for mateably engaging the fastening element of the switching spring.

5. The relay of claim 1 wherein the fixed and movable contacts each further comprising a fastening element, the base element further comprises three slots for mateably engaging the fastening elements of the fixed and movable contacts.

6. The relay of claim 1 wherein an underside of the base element comprises an insulating collar for at least partially accommodating the actuator.

7. The relay of claim 1 wherein the armature further comprises a hole for accommodating the hook element of the actuator.

8. The relay of claim 1 wherein the actuator further comprise a foot portion that is coupled to the switching spring.

9. The relay of claim 1 wherein the coil is disposed within a housing, an end of the housing accommodates the free end of the core limb and further comprises a recess for accommodating the bearing end of the armature.

10. The relay of claim 1 wherein the bearing end of the armature is bent upwards towards the free end of the first yoke limb and wherein the coil is disposed within a housing, and end of the housing comprising a coil body flange for accommodating the free end of the core limb, the coil body flange comprising a recess for accommodating the bearing end of the armature.

11. The relay of claim 1 further comprising a reset spring, the reset spring being coupled to the actuator and biasing the actuator and the pole end of the armature away from the yoke limb.

12. The relay of claim 11 wherein the reset spring is connected to the switching spring.

13. The relay of claim 11 wherein the reset spring and the switching spring are fabricated from a single piece of stamped metal.

14. The relay of claim 1 wherein an upper surface of the base element includes a roll-off edge, said roll-off edge engaging the armature and providing a fulcrum point for armature.

15. An electromagnetic relay comprising:

a U-shaped core yoke having a core limb and a yoke limb, the core limb extending through an elongated coil with a free end of the core limb being disposed outside of the coil, the yoke limb being disposed below the coil and extending along a portion of the coil, the yoke limb having an end portion forming a pole segment, the relay further comprising an armature, the armature comprising an upwardly protruding bearer end disposed adjacent to the free end of the core limb, the armature further comprising an opposing pole end, the opposing pole end being disposed underneath the pole segment of the yoke limb with a working air gap disposed therebetween, the pole end further comprising a hole for accommodating an end of an actuator, the actuator comprising a hooked end and a foot portion, the hooked end of the actuator being accommodated in the hole disposed in the pole end of the actuator, the foot portion of the actuator being coupled to a switching spring, the relay further comprising a base element comprising insulating material, the base element being disposed below the yoke limb and the armature and above the contacts and the switching spring, the base element further comprising a hole, the hook element of the actuator passing through said hole before being coupled to the pole end of the armature, the switching spring being connected to a movable contact, the movable contact being disposed between two fixed contacts.

16. The relay of claim 15 wherein the switching spring is connected to an underside of the base element, the base element defining a contact room for housing the fixed and moveable contacts, the contact room being disposed beneath the yoke limb and beyond the pole end of the armature end.

17. An electromagnetic relay comprising:

a U-shaped core yoke having a U-shaped middle section, core limb and a yoke limb, the core limb extending between first and second ends of an elongated coil with a free end of the core limb being disposed outside of the first end coil, the U-shaped middle section being disposed outside the second end of the coil, the yoke limb being disposed below the coil and extending along a portion of the coil, the yoke limb having an end portion forming a pole segment, the relay further comprising an armature, the armature comprising an upwardly protruding bearer end disposed adjacent to the free end of the core limb, the armature further comprising an opposing pole end, the opposing pole end being disposed underneath the pole segment of the yoke limb with a working air gap disposed therebetween, the pole end further comprising a hole for accommodating an end of an actuator, the actuator comprising a hooked end and a foot portion, the hooked end of the actuator being accommodated in the hole disposed in the pole end of the actuator, the foot portion of the actuator being coupled to a switching spring and a reset spring, the switching spring being connected to a movable contact, the movable contact being disposed between two fixed contacts, the reset spring being coupled to the actuator and biasing the actuator and the pole end of the armature away from the yoke limb, the relay further comprising a base element comprising insulating material, the base element being disposed below the yoke limb and the armature and above the contacts and the switching spring, the switching spring being connected to an underside of the base element, the base element further comprising a hole, the hook element of the actuator passing through said hole before being accommodated in the pole end of the armature, the base element defining a contact room for housing the fixed and moveable contacts, the contact room being disposed beneath the yoke limb and beyond the pole end of the armature end, the base element further defining an insulated switching room for accommodating the switching spring and the foot portion of the actuator.

18. An electromagnetic relay comprising:

a U-shaped core yoke having a core limb and a yoke limb, the core limb extending through an elongated coil with a free end of the core limb being disposed outside of the coil, the yoke limb being disposed below the coil and extending along a portion of the coil, the yoke limb having an end portion forming a pole segment, the relay further comprising an armature, the armature comprising a bearer end disposed adjacent to the free end of the core limb, the armature further comprising an opposing pole end, the pole end of the armature being disposed underneath the pole segment of the core limb with a working air gap disposed therebetween, the pole end of the armature being coupled to an actuator, the actuator being coupled to a switching spring and linking the pole end of armature to the switching spring, the switching spring supporting a movable contact, the movable contact being disposed between two fixed contacts, the relay further comprising a base element comprising insulating material, the base element being disposed below the yoke limb and the armature and the base element being disposed above the contacts and the switching spring, an underside of the base element accommodating the switching spring, the base element further comprising a hole, a hook element of the actuator passing through said hole before coupling to the pole end of the armature, the fixed and moveable contacts being disposed beneath the yoke limb and beyond the pole end of the armature end.

19. The relay of claim 18 wherein the base element further comprises side walls which surround the contacts and form a contact room.

20. The relay of claim 18 wherein the switching spring further comprises a fastening element, the base element further comprises at least one slot for mateably engaging the fastening element of the switching spring.

21. The relay of claim 18 wherein the fixed and movable contacts each further comprising a fastening element, the base element further comprises three slots for mateably engaging the fastening elements of the fixed and movable contacts.

22. The relay of claim 18 wherein an underside of the base element comprises an insulating collar for at least partially accommodating the actuator.

23. The relay of claim 18 wherein the actuator further comprises an upwardly extending hook element and the pole end of the armature further comprises a hole for accommodating the hook element of the actuator.

24. The relay of claim 18 wherein the actuator further comprise a foot portion that is coupled to the switching spring.

25. The relay of claim 18 wherein the coil is disposed within a housing, an end of the housing accommodates the free end of the core limb and further comprises a recess for accommodating the bearing end of the armature.

26. The relay of claim 18 wherein the bearing end of the armature is bent upwards towards the free end of the first yoke limb and wherein the coil is disposed within a housing, and end of the housing comprising a coil body flange for accommodating the free end of the core limb, the coil body flange comprising a recess for accommodating the bearing end of the armature.

27. The relay of claim 18 further comprising a reset spring, the reset spring being coupled to the actuator and biasing the actuator and the pole end of the armature away from the yoke limb.

28. The relay of claim 27 wherein the reset spring is connected to the switching spring.

29. The relay of claim 27 wherein the reset spring and the switching spring are fabricated from a single piece of stamped metal.

30. The relay of claim 18 wherein an upper surface of the base element includes a roll-off edge, said roll-off edge engaging the armature and providing a fulcrum point for armature.

* * * * *